US005370030A

United States Patent [19]

Horne

[11] Patent Number: 5,370,030

[45] Date of Patent: Dec. 6, 1994

[54] POSITIVE-GRIP DRUMSTICK

[76] Inventor: Daniel J. Horne, 4060 Bayshore Dr. #604, Naples, Fla. 33962

[21] Appl. No.: 185,374

[22] Filed: Jan. 24, 1994

[51] Int. Cl.[5] ..... G10D 13/02; A41D 19/00

[52] U.S. Cl. ..... 84/422.4; D17/22; 224/217; 224/910

[58] Field of Search ..... 84/422.4; 224/217, 910; D17/22, 99

[56] References Cited

U.S. PATENT DOCUMENTS

| | | | |
|---|---|---|---|
| D. 32,952 | 7/1900 | Pride | 84/422.4 |
| D. 297,546 | 9/1988 | Seals | D17/22 |
| 3,365,108 | 1/1968 | Giba | 84/422.4 |
| 3,859,887 | 1/1975 | Buchanan | 84/422.4 |
| 3,866,508 | 2/1975 | Huslig | 84/422.4 |
| 4,476,768 | 10/1984 | Willis | 84/422.4 |
| 4,719,836 | 1/1988 | Baumgart | 84/422.4 |
| 4,970,934 | 11/1990 | Reed et al. | 84/422.4 |

*Primary Examiner*—Howard B. Blankenship
*Assistant Examiner*—Cassandra C. Spyrou
*Attorney, Agent, or Firm*—Frank A. Lukasik

[57] ABSTRACT

A non-slip drumstick which uses a flexible, synthetic, finger-band to hold the index finger of a drummer in a fixed position. The invention comprises a cavity formed in the drumstick, a base assembly consisting of a top insert and a bottom insert and a finger-holding, flat surfaced "O" ring assembled in a slot in the top insert. The top and bottom inserts grip a pair of horizontal ribs formed in the cavity and lock together with latches formed in the top and bottom inserts. The drummer can use either an over or under hand grip. The flexible band can conform to the shape, angle, and movement of the index finger.

4 Claims, 7 Drawing Sheets

POSITIVE-GRIP DRUMSTICK

BACKGROUND OF THE INVENTION

1. Field of the Invention

This invention relates generally to drumsticks and more particularly, to non-slip drumsticks which use a flexible, synthetic finger-band to hold the index finger in a fixed position.

2. Description of the Prior Art

Many musical groups of today such as marching bands, dance bands, and the like, present musical interludes for viewing by multitudes of people, such as in parades, during half-time activities of an athletic contest, during a "pop" music concert, or the like. A drummer and the drumbeat which a drummer provides to a musical group is indispensable to that group. The drumbeat becomes the basic beat of the music that emanates from the group. The rhythm of the dream may at times stand alone in a musical composition, but a composition is seldom without the rhythmic accompaniment of a drum. The main contribution and his playing to music are aural. However, the contribution is also visual. The flash of the spinning drumsticks and the rhythmic waving of the drummer's hands, arms, and the whole body are part of the drummer's presence.

When performing with a standard drumstick, the drummer has a preferred grip location on the shaft. This position is what produces the optimum performance. While playing, the drummer frequently loses the preferred grip and has to regain the original position. Occasionally, the drumstick may slip completely out of the drummer's hand. The problem becomes worse if the drummer's hand is sweaty. This slippage is due mainly to the centrifugal force of the front section of the drumstick while in motion. Several prior art attempts have been made to assist in gripping a drumstick.

One such attempt may be found in U.S. Pat. No. 297,546 to Seals which shows a drumstick having a large wrist band attached thereto. U.S. Pat. No. 3,365,108 to Giba discloses a retaining device for drumsticks wherein a ring which is worn on a finger of the drummer's hand is connected to the drumstick by a short, flexible, and freely swiveling connection whose length is such that when the drumstick is held in the proper playing position there is not interference with the use of the drumstick and when the drummer releases his finger grip on the drumstick, the same remains within reach of his fingers.

U.S. Pat. No. 3,859,887 to Buchanan discloses a drumstick gripping aid provided with a freely pivotal grip which serves as an instructional aid by which the drumstick can be held without interfering with the free angular movement of the drumstick about the pivot axis between the grip and the drumstick. U.S. Pat. No. 3,866,508 to Huslig discloses a drumstick constructed with at least a portion of the length thereof to be gripped by a user generally flattened in one transverse direction to facilitate more comfortable and positive holding and manipulation of the stick.

U.S. Pat. No. 4,719,836 to Baumgart discloses a drumstick or the left hand having three recesses in the peripheral region of the short flexor of the thumb, another for the ring finger, and the third for the middle finger. U.S. Pat. No. 4,476,768 to Willis discloses a drumstick having a non-bulbous tip and a grip portion to facilitate holding of the stick. The end of the stick is sharply tapered, ending in a point.

None of the above prior art devices provide the convenience, simplicity, nor effectiveness of the flexible, synthetic fingerband of the present invention to hold the index finger, and thus the hand, in a fixed position and still provide a pivot point for spinning (revolving) the stick around the finger.

SUMMARY OF THE INVENTION

To prevent slippage, the ;present invention uses a flexible, synthetic, finger-band to hold the index finger (and with it the hand grip) in a fixed position. The drummer can use either an over or under hand grip. The flexible band can conform itself to the shape, angle, and movement of the index finger. The invention can also be used to enhance the visual appeal of the drummer's performance. Since the finger-band forms a complete ring around the index finger, the drumstick can be twirled around the axis of the finger. If the finger-band is not excessively loose or flexible, the user can maintain a moderate amount of control.

BRIEF DESCRIPTION OF THE DRAWINGS

FIG. 6 is a side view of the bottom insert of the drumstick insert of the invention.

FIG. 7 is a bottom view of the bottom insert of the drumstick insert of the invention.

FIG. 8 is a top view of the bottom insert of the drumstick insert of the invention.

DESCRIPTION OF THE PREFERRED EMBODIMENT

Figure 2:
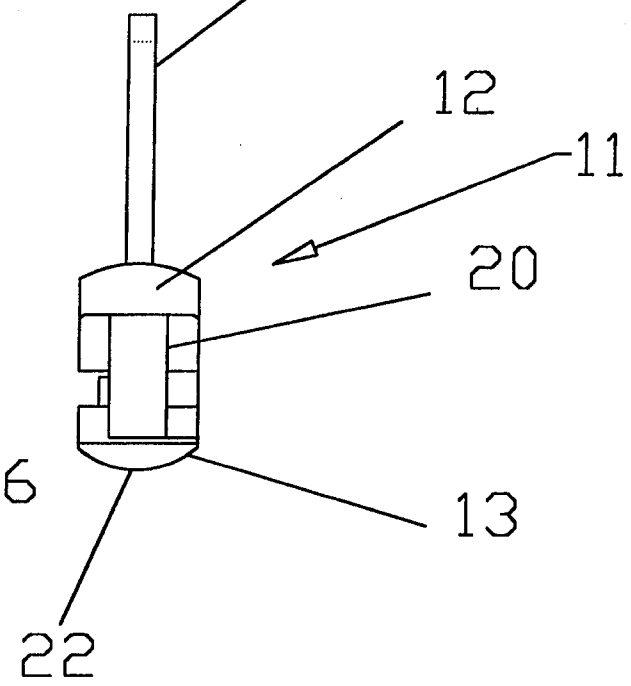
FIG. 2 is an end assembly view of the finger-band drumstick insert of the invention.
Figure 1:
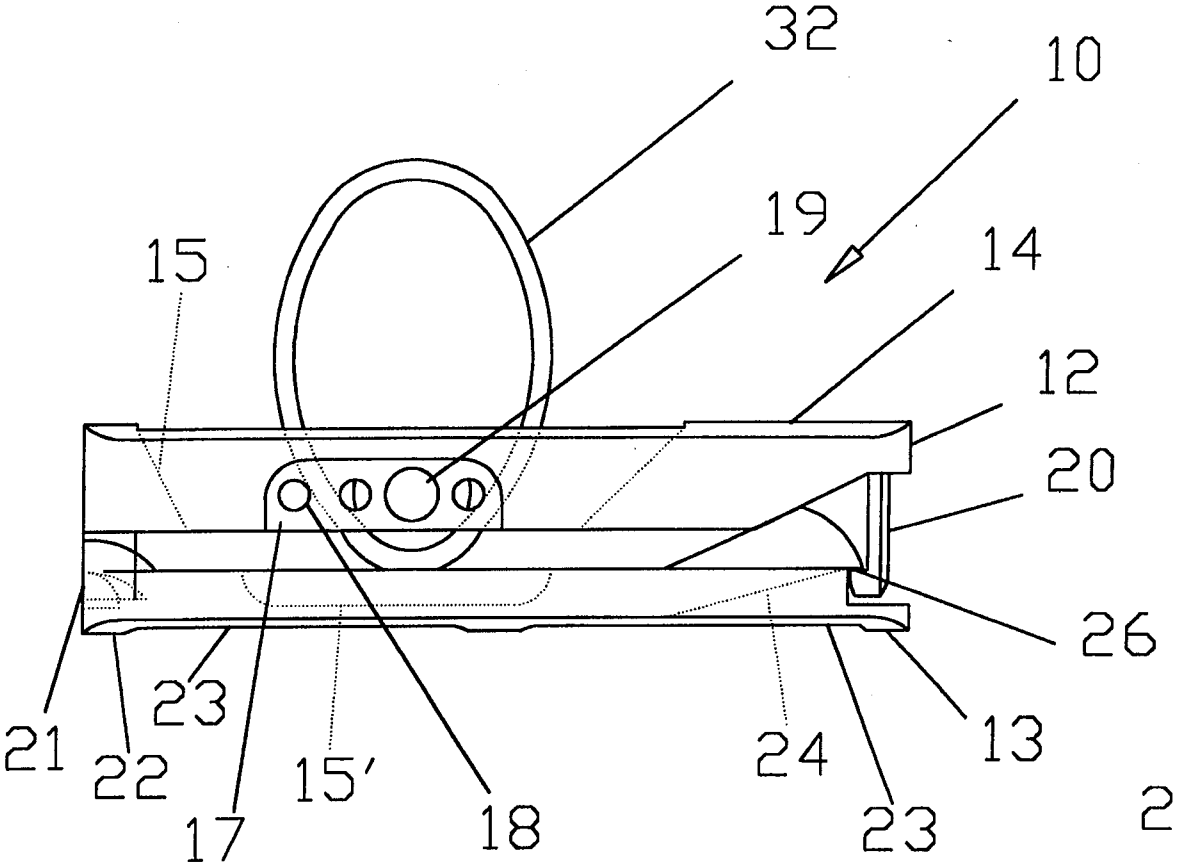
FIG. 1 is a side assembly view of the finger-band drumstick insert of the invention.
Figure 4:
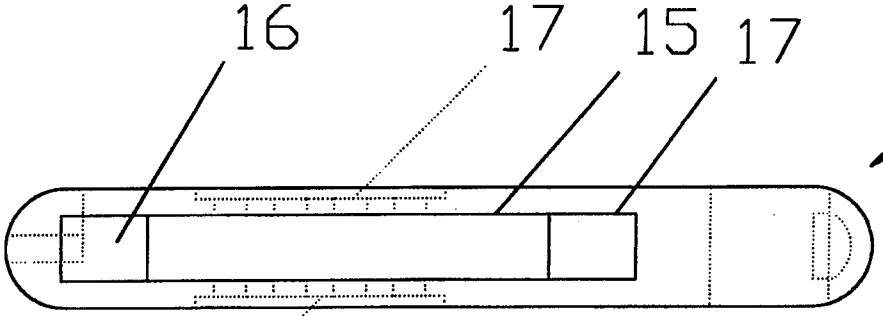
FIG. 4 is a top view of the top insert of the drumstick insert of the invention.
Figure 3:
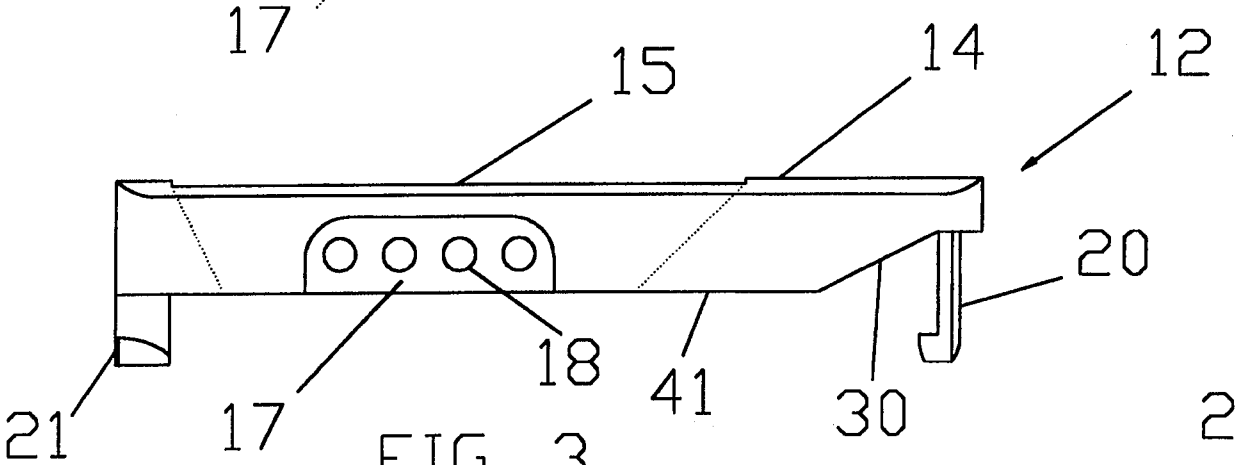
FIG. 3 is a side view of the top insert of the drumstick insert of the Invention.
Figure 5:
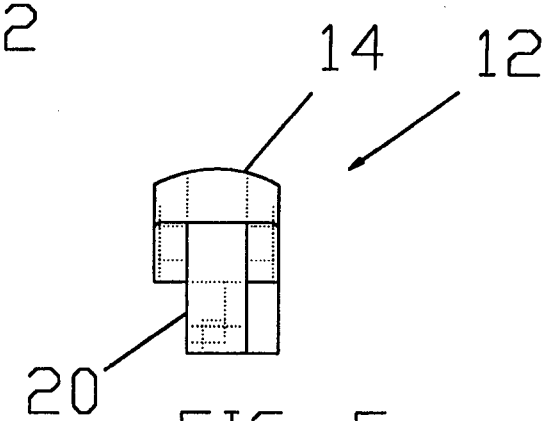
FIG. 5 is an end view of the top insert of the drumstick insert of the invention.
Figure 9:
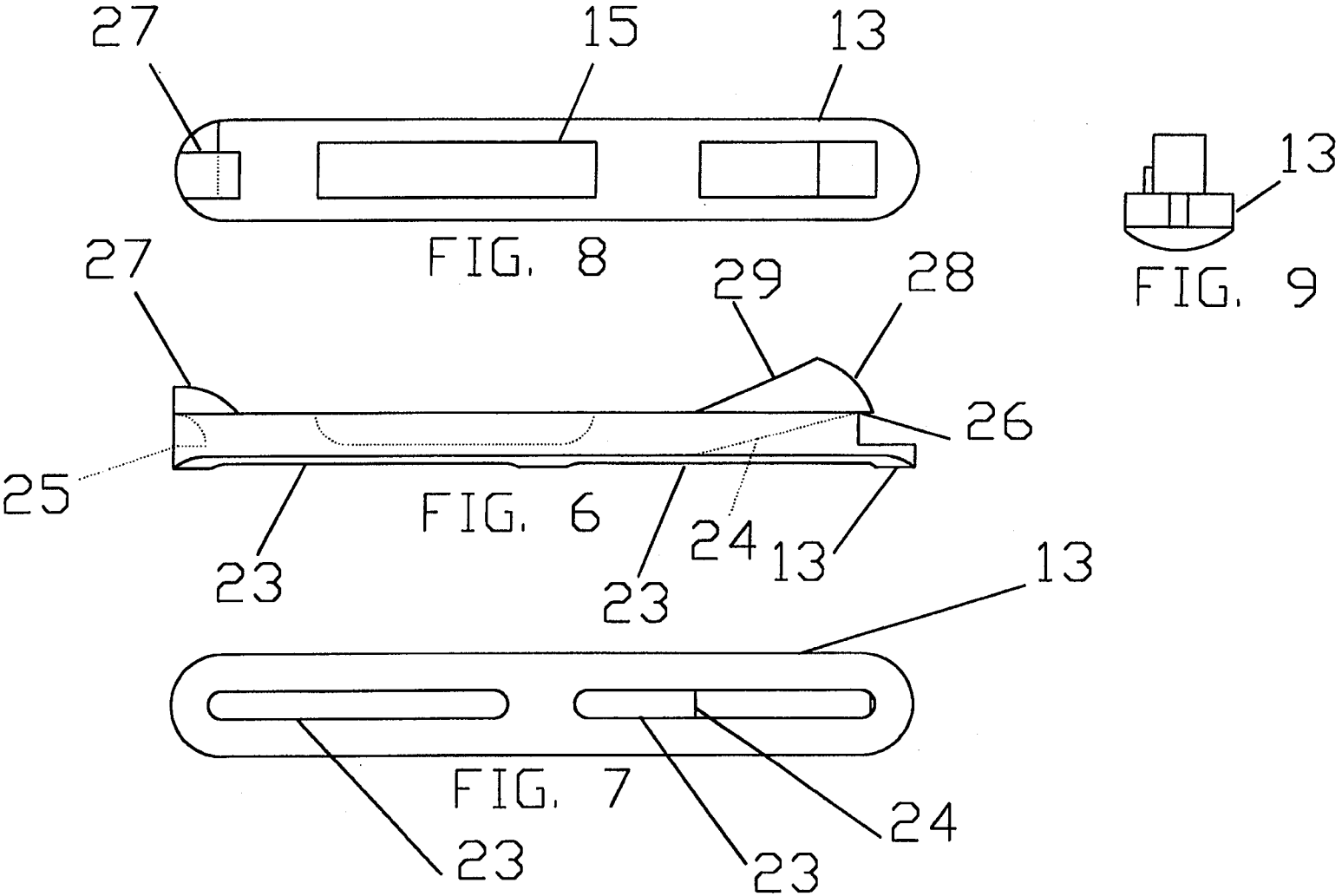
FIG. 9 is an end view of the bottom insert of the drumstick insert of the invention.
Figure 12:
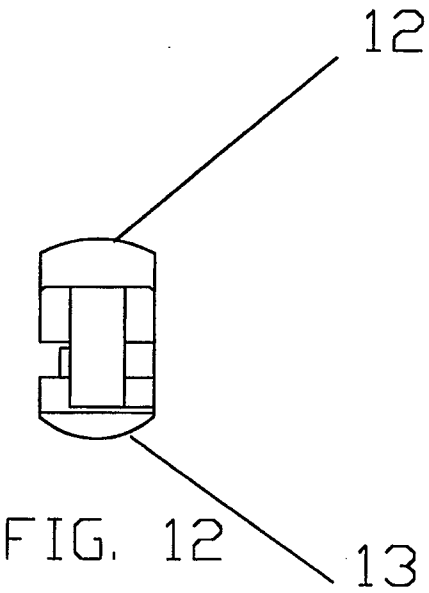
FIG. 12 is an end assembly view of the top and bottom inserts of the drumstick insert of the invention.
Figure 11:
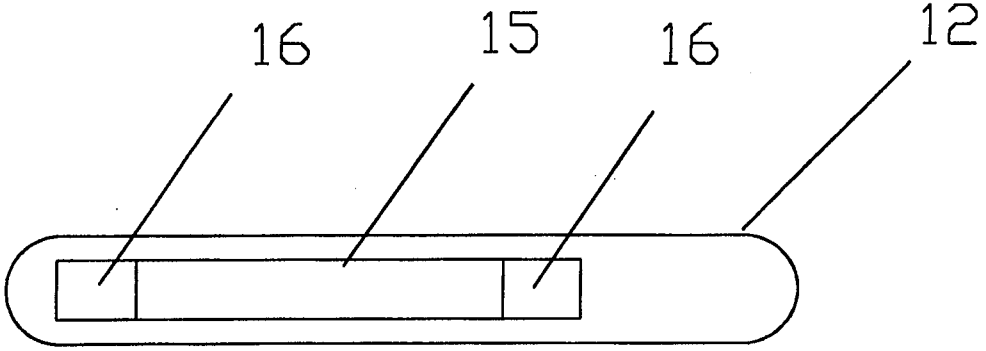
FIG. 11 is a top assembly view of the top and bottom inserts of the drumstick insert of the invention.
Figure 10:
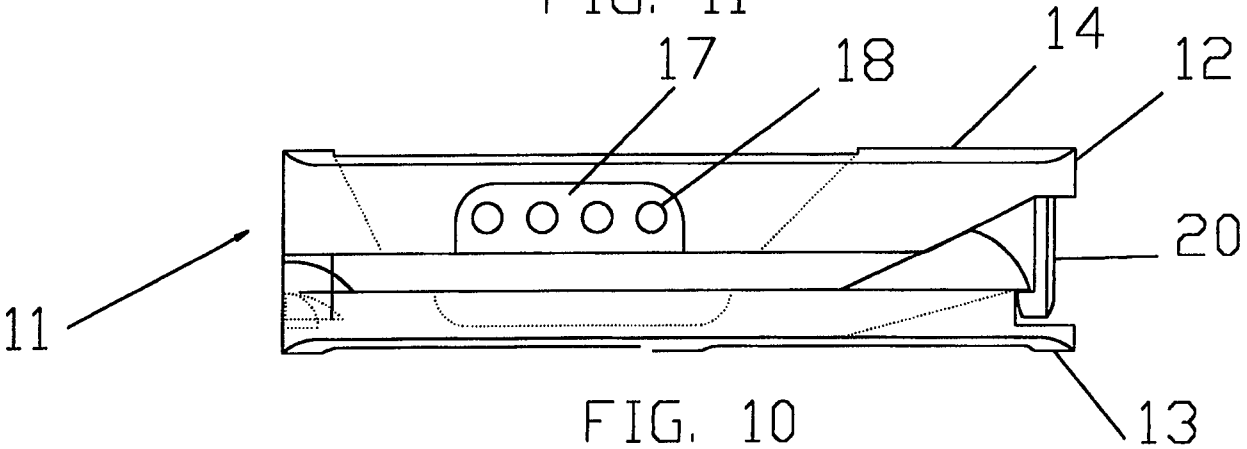
FIG. 10 is an assembly view of the top and bottom inserts of the drumstick insert of the invention.
Figures 13, 14, 15, 16:
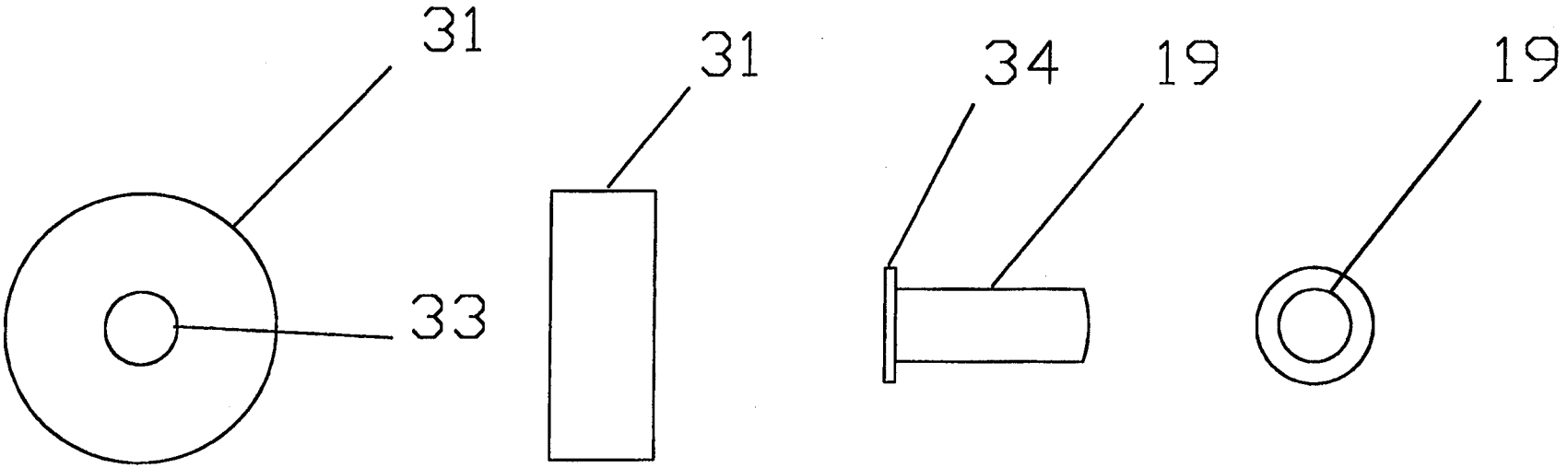
FIG. 13 is a front view of the finger-band wheel of the invention.
FIG. 14 is an end view of the finger-band wheel of the invention.
FIG. 15 is a front view of the wheel axle of the invention.
FIG. 16 is an end view of the wheel axle of the invention.

The positive-grip drumstick insert of the invention is shown in FIG. 1 and is indicated generally by reference character 10 and comprises a base assembly 11 consisting of a top insert 12 and a bottom insert 13. Inserts 12 and 13 may preferably be formed of plastic such as, for example, thermoplastic and LEXAN. Top insert 12 has a curved top surface 14 with a radius to match the radius of a drumstick. A slot 15 is formed through top insert 12 and has angled surfaces 16 formed therein to provide a wider clearance area. Slot 15' is formed in the bottom of insert 13 to provide clearance. Recesses 17 are formed on opposite sides of top insert 12 and holes 18 are provided for mounting wheel axle 19. Latches 20 and 21 are formed on opposite ends of top insert 12.

Bottom insert 13 has a curved bottom surface 22 with a radius to match the radius of a drumstick, a flat surface 23 and slot 24 formed through bottom insert 13 to provide access to the lock area of base assembly 11 when fully assembled. Recesses 25 and 26 are formed in bottom insert 13 to provide latching surfaces for latches 20 and 21. Radiused surfaces 27 and 28 provide camming surfaces when top and bottom inserts 12 and 13 are assembled to comprise base assembly 11. Angled surface 30 is formed on top insert 12 to provide clearance for angled surface 29 formed on bottom insert 13 when assembled.

To complete assembly of top insert 12, synthetic fingerband 32 is placed on wheel 31 and the wheel 31 and finger-band 32 are inserted into slot 15 and aligned with one of the holes 18. Wheel axle 19 is inserted through a hole 18, which is aligned with wheel 31, and axle 19 is pushed through the pivot hole 33 in wheel 31 and through the opposite side hole 18. Axle head 34 is pushed until it abuts the recess surface 17.

Another characteristic of the instant invention is in the location of the wheel slot 15 which is off center from the insert 10 length. The insert 10 can be reversed to double the number of wheel mount positions shown in the preferred embodiment. Using this approach enables the wheel slot 15 to be much shorter, which adds strength to the insert 10. It also leaves more room at one end of the insert 10 for a locking mechanism such as latch 20.

Finally, one of the goals of the invention was cost effectiveness. To help achieve this, the components were designed to be transferable. When an old drumstick is worn out, the user simply pushes in the insert 10 release latch 20 and removes insert 10. The components can be removed and snapped together in the replacement drumstick for reuse.

Figure 18:
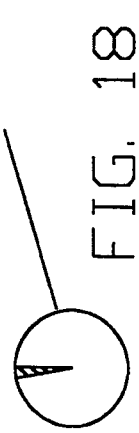
FIG. 18 is a tip end view of a router bit used to create a slot in a drumstick.
Figure 20:
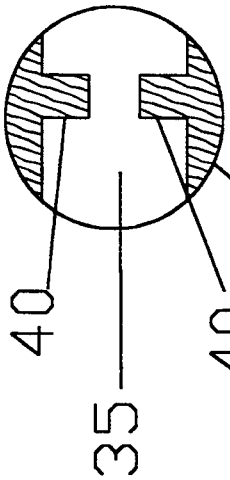
FIG. 20 is a section of the drumstick slot along lines A—A.
Figure 17:
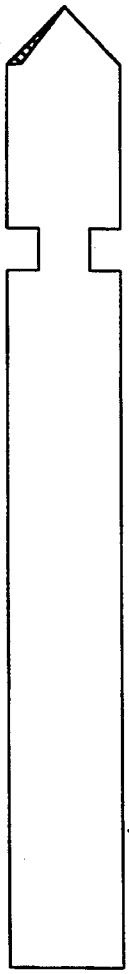
FIG. 17 is a side view of a router bit used to create a slot in a drumstick.
Figure 19:
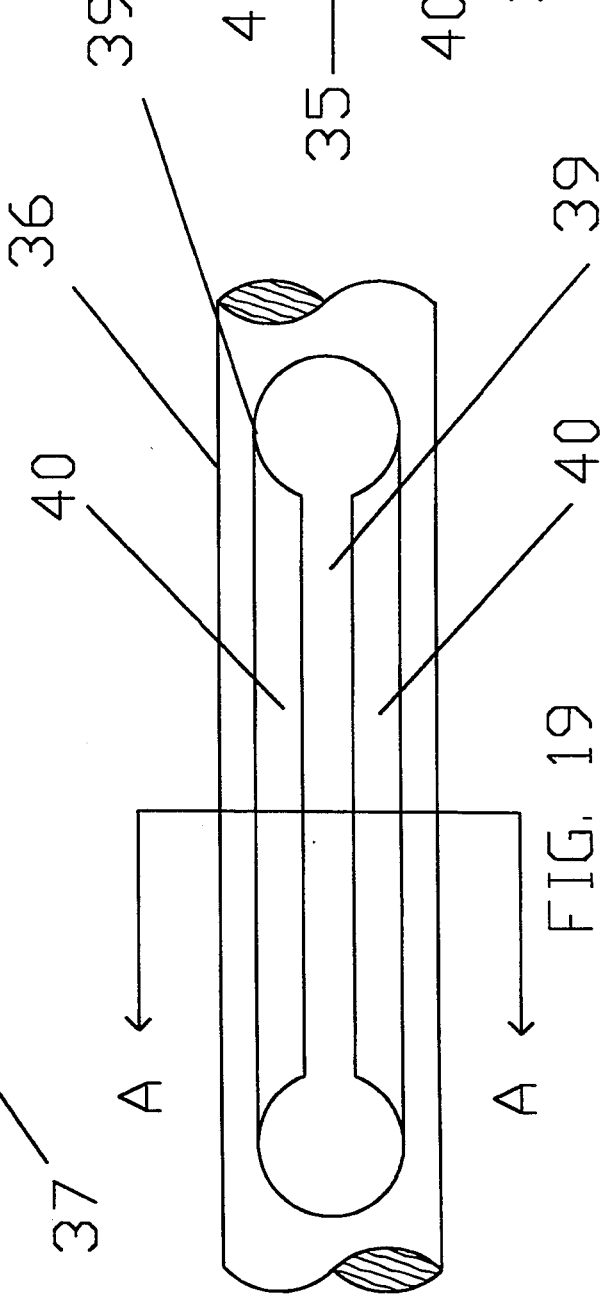
FIG. 19 is a top view of a slot cut in a drumstick for holding the drumstick insert.
Figure 22:
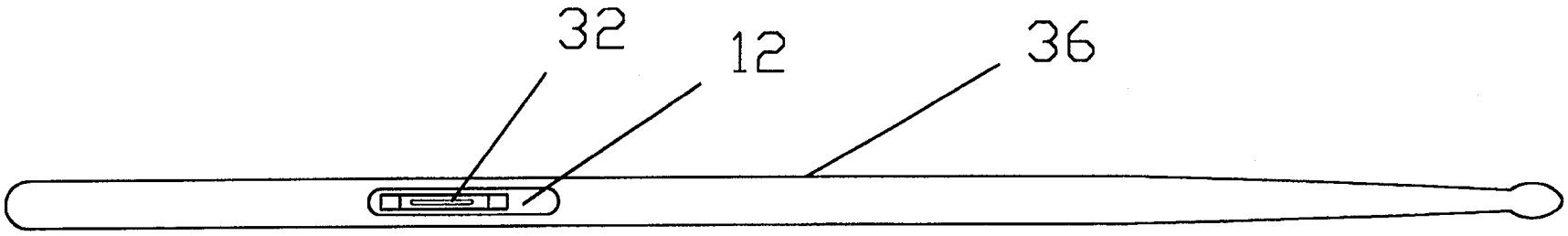
FIG. 22 is a top view of a positive-grip drumstick insert assembled in a drumstick.
Figure 21:
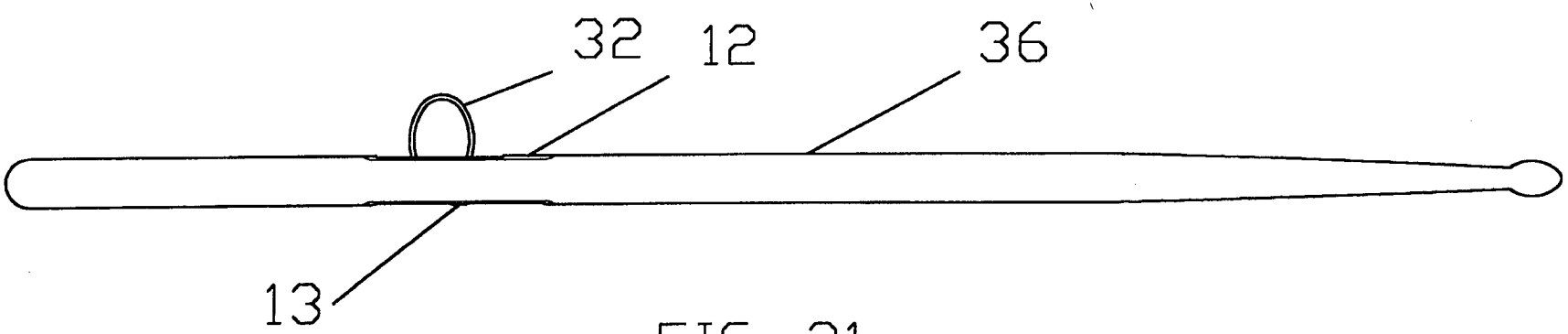
FIG. 21 is a side view of a positive-grip drumstick insert assembled in a drumstick.

Another step taken toward cost effectiveness is in the design of the replacement drumstick. Cavity 35 is machined or drilled perpendicular to the axis of drumstick 36 to accommodate the insertion of drumstick insert 10. Unlike the molded insert 10, the wooden drumstick 36 has to be machined. The drumstick 36 modification can be completed in a single step. The modification begins with a special router bit 37 shown in FIGS. 17 and 18. The point of the bit 37 first drills a hole 38, and then moves parallel to the axis of the drumstick 36 shaft, and is then pulled upwardly. This drilling-routing process creates a slot 39 with interior ribs 40. The interior ribs 40 strengthen the slot 39 area and are sandwiched between inserts 12 and 13 to hold them in place.

After the drumstick cavity 35 is formed, top insert 12 is inserted into cavity 35 and pushed until bottom surface 41 touches the interior ribs 40. Bottom insert 12, is inserted into cavity 35 until recess 25 engages latch 21 of top insert 12. Continued pressure on bottom insert 13 will move it into the cavity 35 until latch 20 of top insert 12 engages recess 26 of bottom insert 13. To provide a snug fit against the interior ribs 40, either top insert 12, or bottom insert 13, or both, may be slightly warped and when elastically deformed during assembly, will snugly grip the interior ribs 40 when the two inserts are assembled in the drumstick 36. To disassemble drumstick insert 10, a slender tool, such as a screwdriver, is inserted through slot 24 in bottom insert 13, and pushed against latch 20 of top insert 12 to disengage latch 20 from recess 26.

An important use of the invention can be in training of drummers. The finger-band 32 holds the index finger against the drumstick shaft. In many situations, this can aid in conditioning a drummer to use a proper grip.

The principle feature of the invention is the finger-band wheel 31. This insert-mounted wheel 31 serves several functions. First, it allows the finger-band 32 to be circulated. This produces an even wear pattern on the finger-band 32 and tends to make it last longer. In a preferred embodiment the fingerband 32 was a flexible, plastic, flat surfaced, "O" ring. Since "O" rings are commercially available, a user of the invention has a wide selection of sizes available to select the optimum size for his own use. Second, when the drumstick 36 is being twirled, the wheel 31 spins. This greatly reduces friction between the finger-band 32 and the finger. The drumstick 36 can then be twirled more aggressively and with less worry of skin irritation. Third, another benefit of the wheel 31 is that its axle 19 can easily be relocated which would also change the hand position. This adds to the versatility of the invention since many drummers have different preferred grip areas.

The present embodiments of the invention are thus to be considered in all respects as illustrative and not restrictive, the scope of the invention being indicated by the appended claims rather than by the foregoing description. All changes which come within the meaning and range of equivalency of the claims are intended to be embraced therein.

What is claimed is:

1. A positive-grip drumstick insert for retaining a drumstick in the hand of a drummer and for twirling the drumstick around a finger, the drumstick having a cavity formed perpendicular to the axis of the drumstick and the drumstick cavity having horizontal ribs opposing each other, the insert comprising:

a base assembly having a horizontal axis, and having a top insert, and a bottom insert, said top insert, having a first end and a second end, a first exterior side and a second exterior side, a top curved surface and a bottom flat surface, and having a slot formed, through said top insert, perpendicular to said axis and located off center, closer to said first end, said top insert having recesses formed on each of said exterior sides and having a plurality of mounting holes formed through said top insert, perpendicular to said recesses, said top insert having latch means formed at said first and second ends, extending beyond said bottom flat surface, said bottom insert, having a first end and a second end, a bottom curved surface and a top flat surface, and having a plurality of slots formed in said bottom insert, perpendicular to said axis, said bottom insert having latching means formed at said first and second ends for engaging said latch means when said top insert and said bottom insert are installed in said drumstick cavity, and finger-holding means assembled in said slot in one of said holes in said top insert to provide a grip to hold a finger of said hand, whereby said top insert and said bottom insert are inserted within said drumstick cavity, thereby forming said base assembly and gripping said horizontal ribs between said top insert and said bottom insert for retaining said base assembly in said drumstick.

2. A positive grip drumstick insert for retaining a drumstick of claim 1, wherein said finger holding means consists of a wheel and axle mounted in one of said top insert holes and a finger band.

3. A positive grip drumstick insert for retaining a drumstick of claim 2, wherein said finger-band consists of a flat surfaced "O" ring.

4. A positive grip drumstick of the type used by a musician for playing a percussion instrument such as a drum, comprising:

a cavity formed perpendicular to the axis of said drumstick, said cavity having horizontal ribs opposing each other, a base assembly having a horizontal axis, and having a top insert, and a bottom insert, said top insert having a first end and a second end, a first exterior side and a second exterior side, a top curved surface and a bottom flat surface, and having a slot formed, through said top insert perpendicular to said axis and located off center, closer to said first end, said top insert having recesses formed on each of said exterior sides and having a plurality of wheel mounting holes formed through said top insert, perpendicular to said recesses, said top insert having latch means formed at said first and second ends, extending beyond said bottom flat surface, said bottom insert, having a first end and a second end, a bottom curved surface and a top flat surface, and having a plurality of slots formed in said bottom insert perpendicular to said axis, said bottom insert having latching means formed at said first and second ends for engaging said latch means when said top inserts and said bottom insert are installed in said drumstick cavity, and finger-holding means assembled in said slot in one of said holes in said top insert to provide a grip to hold a finger of said hand, said finger-holding means consisting of a wheel and axle mounted in one of said top insert holes and a flat surfaced "O" ring assembled in said slot in said top insert to provide a grip to hold a finger of said hand, whereby said top insert and said bottom insert are inserted within said drumstick cavity thereby forming said base assembly and gripping said horizontal ribs for retaining said base assembly in said drumstick.

* * * * *